United States Patent [19]

Meroni et al.

[11] Patent Number: 4,682,466

[45] Date of Patent: Jul. 28, 1987

[54] DEVICE TO DOFF YARN PACKAGES ON RING SPINNING MACHINES

[75] Inventors: Roberto Meroni; Danny Lant, both of Pordenone; Fabio Lancerotto, Milan; Umberto Gerin, Pordenone, all of Italy

[73] Assignee: S. Bigagli & C. SpA, Prato, Italy

[21] Appl. No.: 841,782

[22] Filed: Mar. 20, 1986

[30] Foreign Application Priority Data

Mar. 26, 1985 [IT] Italy ..... 83349 A/85

[51] Int. Cl.[4] ..... D01H 9/04; D01H 9/02; D01H 9/18

[52] U.S. Cl. ..... 57/274; 57/266; 57/270; 57/275

[58] Field of Search ..... 57/266, 268, 274–276, 57/270, 273

[56] References Cited

U.S. PATENT DOCUMENTS

| | | | |
|---|---|---|---|
| 1,463,479 | 7/1923 | Miller | 57/275 X |
| 2,716,326 | 8/1955 | Colvin | 57/266 |
| 3,350,868 | 11/1967 | Winter | 57/275 |
| 3,808,788 | 5/1974 | Viglione | 57/275 |
| 4,036,001 | 7/1977 | Tamai et al. | 57/275 X |
| 4,571,930 | 2/1986 | Chiari et al. | 57/274 |

*Primary Examiner*—John Petrakes

*Attorney, Agent, or Firm*—Wegner & Bretschneider

[57] ABSTRACT

Device (10) to doff yarn packages on ring spinning machines (12) which is able to doff the yarn packages (15) automatically and to replace them with empty tubes (16), and which comprises a movable gripper (17), a station (20) to engage tubes and means (31) to remove yarn packages, the gripper (17) comprising an element (25) to engage yarn packages and an element (26) to engage tubes and being able to rotate about a horizontal shaft (24) so as to bring one or the other engagement element (25–26) to cooperate with the spindle shaft (23) momentarily, the gripper (17) being able to move vertically and normally staying in a position (17B) where it does not interfere with the zone of the spindle (13).

10 Claims, 3 Drawing Figures

DEVICE TO DOFF YARN PACKAGES ON RING SPINNING MACHINES

This invention concerns a device to doff yarn packages on ring spinning machines. To be more exact, the invention concerns a device to doff yarn packages and to replace them with empty tubes taken from appropriate temporary lodgement stations.

The device of the invention is intended in particular, but not only, for machines to spin carded wool.

The doffing of yarn packages by hand and their replacement by hand with empty tubes are known.

Automatic systems for the doffing of yarn packages and for their replacement by tubes are also known. Such known automatic systems comprise mechanical devices located in the part of the machine which includes the spindles. The zone of the spindles is therefore unavoidably occupied by such devices in their waiting position while the spindles are working. Access to the machine is therefore restricted.

Another consequent drawback lies in the fact that, owing to the positioning given to such devices, the spindles have to remain halted until the exchange operation has been completed and the device has been brought to a position where it does not come into contact with the spindles although it is close to them.

In general, creels are employed which can take and extract the yarn packages from the spindles; means are also used which can take the tubes from an appropriate station or stock generally positioned in the lower part of the spinning machine and can load such tubes onto the spindles.

These devices therefore entail the drawback of requiring rather a long time for changing the yarn packages, such time amounting to some minutes in the best cases, with the resulting stoppages of the machine and relative loss of output.

Patent DE-A No. 1.934.358, for instance, is known and discloses a complicated device comprising a gripper able to move vertically by means of a system of chains. A container for a reserve tube is provided and is solidly fixed to the gripper, such tube has to be inserted into this container by hand beforehand. The gripper can be displaced transversely so that when the yarn package has been removed from the spindle, the container can be brought into position, with the tube above the spindle. Moreover, the whole gripper can be overturned by 180° to perform discharge of the yarn package outside the spinning machine. This device entails the drawback of a stationary bulky mass in correspondence with the zone of the spindles,owing to the chain that moves the gripper and the relative stationary supports. Moreover, the device is very complicated as regards its mechanical structure and also as regards the many movements and relative actuation systems required. Furthermore, to perform the exchange, the device has to carry out two vertical movements, which involve long change-over times.

TEXTIL-PRAXIS of January 1964 discloses on page 15 a device produced by Jacobi & Co., which is equipped with a double gripper to doff the yarn packages and insert the tubes. The tube is held in this device by a mechanical coupler, which is only suitable for grooved tubes. The double gripper includes two grippers at 90° to each other. The yarn package is engaged by a movement of inclination of the relative gripper, which creates a mechanical joint. When the yarn package has been doffed from the spindle, it falls on its own out of the gripper into a discharge position. This device performs a whole series of movements and is therefore very complicated. In particular, the two grippers cannot only move, solidly fixed to each other, about an axis but can also move reciprocally, one being superimposed on the other during the step of release of the tube on the spindle. The empty tubes in the reserve position are low down in the zone of the spindles and are inserted into the grippers by hand. Moreover, the device entails a stationary bulky mass in the zone of the spindles.

Patent DE-A No. 2613900 in the name of Toyoda discloses a complex device including a movable and inclinable rail which is able to take tubes from a low reserve position, to bring them above the yarn packages and at the same time to engage an empty tube and the top of the yarn package, to withdraw the yarn package from the spindle and discharge it in a reserve position, and then to take the empty tube back to the zone of the spindles and position it on the spindle itself. This device entails a whole series of movements and, in particular, a double vertical travel, besides the required inclination of the whole movable rail. Moreover, this device too creates a stationary bulky mass in the zone of the spindles, thus restricting accessibility to the spindles.

Patent FR-A No. 1.173.911 discloses a device with grippers to withdraw the yarn package and the tube by gripping them, the grippers consisting of a rubber membrane with toothed engagement apertures. This device has a very complex actuation system with programming cams and mechanical transmission means to move the grippers; it also creates a stationary irremovable bulky mass at the front of the spinning machine.

Patent CH-A No. 84427 discloses a device with a gripper producing a resilient grip provided by resilient blades. The gripper can be rotated by 180° to exchange an empty tube for the yarn package doffed from the spindle. This gripper can also be raised and lowered by worm-screw means. The overall device can be turned over completely by 180° so as to take the gripper, together with a full yarn package doffed from the spindle, to a position suitable for withdrawal of the yarn package by the machine operative. The device works slowly and performs not only the rotary movement for overturning the grippers and the vertical movement of the grippers themselves but also the cited movement of overturning of the whole device by the worm-screw so as to bring the yarn packages to a position where they can be withdrawn by hand. The device is therefore slow and complicated and also creates a permanent bulky mass in the zone of the spindles.

U.S. Pat. No. 2,716,326 discloses a very complicated doffing device consisting of a movable rail with overturnable grippers to engage the yarn packages. In this device the grippers, which are normally lodged below the zone of the spindles in their inactive position, are moved by actuation cams along a complicated path with a plurality of movements and relative actuation systems. In particular, the raising takes place by means of a worm-screw and is therefore slow. The device comprises also a stationary framework of considerable vertical and transverse bulk.

One purpose of this invention is therefore to provide a device to replace yarn packages with empty tubes which changes the yarn packages particularly quickly and efficiently.

Another purpose of the invention is to provide a device which has a mainly vertical development and is such that it normally stays above the zone of the spindles, thus leaving that zone completely free and accessible.

One considerable advantage of this invention, which results from its structural simplicity and functional nature, is that its time for exchanging the yarn packages with new tubes is much shorter than with the known embodiments.

The invention obtains the above purposes using a double gripper which can withdraw the yarn packages and can bear tubes taken from a conveyor, such as a conveyor belt for instance, arranged above the spinning machine.

According to the invention the gripper normally stays above the zone of the spindles. The position for taking the empty tubes and consigning the completed yarn packages is such as to enable the movement of the gripper to overlap the stoppage and start-up of the spindles partially in time.

In particular, after the change-over of tubes for yarn packages, the spindles can be started up well before the gripper has reached the position for consigning the yarn packages. This shortens the downtimes of the machine considerably and therefore enables output to be increased to a great extent.

The gripper can bear a yarn package and a tube in appropriate engagement means at one and the same time and can rotate about a shaft so as to exchange the respective positions of the completed yarn package and of the tube.

Moreover, such gripper can move vertically to extract the yarn package from the spindle, to take a new tube and lodge it on the spindle and also to place the yarn package on a removal conveyor, which will advantageously be the conveyor that feeds the tubes but may also be a separate conveyor.

According to the invention the gripper can rotate about a horizontal shaft and the change-over of the respective positions of the yarn package and tube is carried out by a 180° rotation of the gripper about such shaft after the gripper has been raised to a position where it will not come into contact with the elements of the spinning machine.

This invention is therefore embodied with a device to doff yarn packages on ring spinning machines which is able to doff the yarn packages automatically and to replace them with empty tubes, and which comprises a movable gripper, a station to engage tubes and means to remove yarn packages and is characterized in that the gripper comprises an element to engage yarn packages and an element to engage tubes, such gripper being able to rotate about a horizontal shaft so as to bring one or the other engagement element to cooperate with the spindle shaft momentarily, the gripper being able to move vertically and normally staying in a position where it does not interfere with the zone of the spindle.

We shall now describe a preferred embodiment of the invention as a non-restrictive example with the help of the attached figures, in which.

Figure 1:
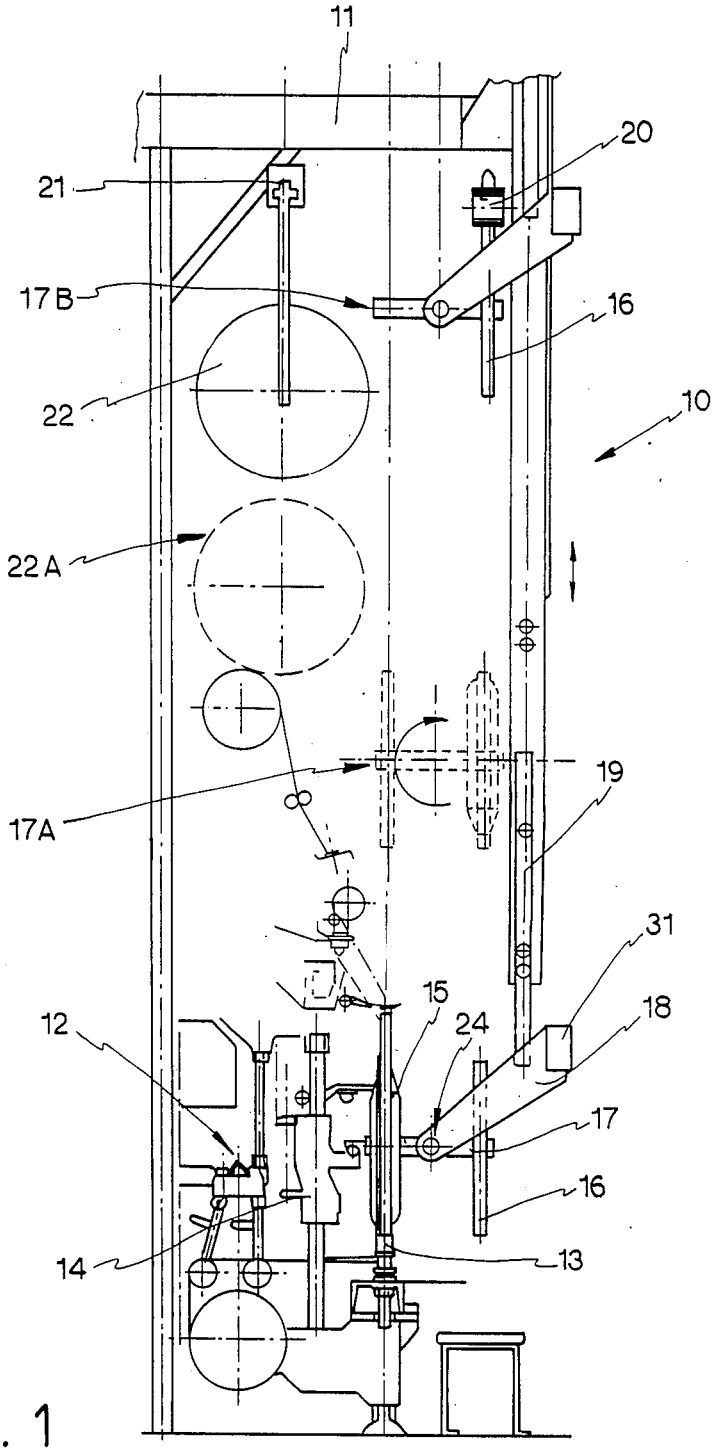
FIG. 1 is a diagrammatic side view of the device of the invention as fitted to a machine to spin carded wool.

In FIG. 1 a device 10 to doff yarn packages according to the invention is attached to a stationary structure 11 solidly fixed to a spinning machine 12 shown diagrammatically.

A spindle 13 and relative actuation means, a ring carriage 14 and a completed yarn package 15 on the spinning machine 12 can be seen.

The device 10 comprises essentially a double gripper 17 able to take and support the yarn package 15 and a tube 16 at one and the same time.

The gripper 17 is supported rotatably by an arm 18, which can move vertically by means of a telescopic guide 19, which may consist of one or more slidable elements moved by cables, ropes or chains or other analogous means, for instance.

In the embodiment of FIG. 1 the various arms 18 which act as supports for a shaft 24 that bears the grippers 17 are connected together by structural members 31 running lengthwise along the spinning machine 12.

A conveyor 20 to delivery tubes 16 can be seen above the spinning machine 12. The tubes 16 are taken from this conveyor 20 at position 17B of the gripper 17. The conveyor 20 is equipped with retractable pins known in themselves and therefore not shown, or with other analogous means to bear the tubes 16 and thereafter the yarn packages 15 consigned to such pins.

A conveyor 21 can also be seen which feeds packages 22 of carded wood to the spinning machine 12; such packages 22 are placed in their working position 22A.

The device 10 works in the following manner: when the yarn package 15 has been completed, the gripper 17, which is in its upper position 17B and has engaged a tube 16, descends until it engages the yarn package 15. The spindles are halted during this descent.

The gripper-bearing shaft 24 then ascends once more by means of the telescopic guide 19 until it has brought the gripper 17 to position 17A at a height great enough to prevent any contact with the elements of the spinning machine 12.

Figure 2:
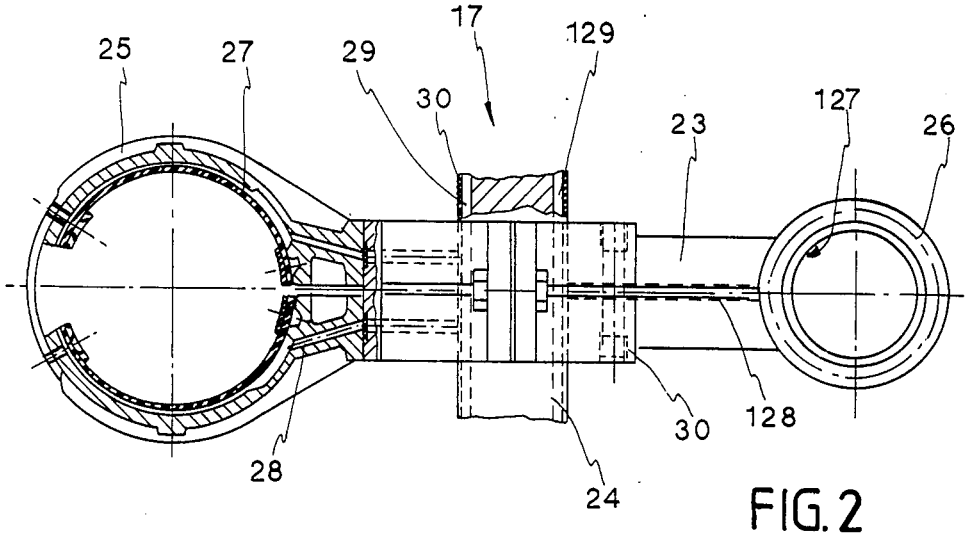
FIG. 2 is a plan view of the gripper.

The gripper 17 is now rotated by 180° about the horizontal shaft 24 (see also FIG. 2). Such shaft 24 serves all the grippers 17, actuation being provided by one single actuator of any known type, such as an electric motor, a jack or the like.

When such rotation has been carried out, the yarn package has been turned upside down outside the spinning machine, whereas the tube 16 is on an axis above the spindle (see position 17A).

The gripper 17 is now lowered again until it has brought the new tube 16 to be lodged on the spindle 13. The gripper 17 is then opened to release the tube 16 on the spindle 13.

Next, the gripper ascends again; when the gripper has reached a position far enough from the spindle 13, the latter is started up and thus begins a new spinning cycle.

The gripper 17 then continues ascending until it has consigned the yarn package 15 to the conveyor belt 20. The gripper now opens, releases the yarn package and descends enough not to interfere with the movement of the conveyor 20, which now bears the yarn packages to be removed.

When the yarn packages 15 have been removed and the new tubes 16 have been positioned by the conveyor 20, the gripper 17 rises to 17B and engages the tubes so as to begin a new cycle.

The tubes 16 can be placed on the conveyor 20 automatically or by hand. For instance, a station for loading the conveyor will be included, being already known in itself.

The above doffing cycle requires a very short time to be accomplished, as compared to the known embodiments. This is made possible by the partial overlapping in time of the rotation of the spindles with the movements of the gripper, such movements, as we have said, providing for a vertical movement towards the spindle to take the yarn package, another vertical travel upwards to reach the position of rotation 17A of the gripper, a further downward vertical movement to place the tube 16 on the spindle 13 and a further ascent of the gripper 17 to consign the yarn package, plus a slight lowering of the gripper so as not to contact the conveyor 20 during removal and a subsequent re-positioning at 17B. Normally, that is, during formation of the yarn package 15, the gripper 17 will stay at position 17B in the example shown.

Figure 3:
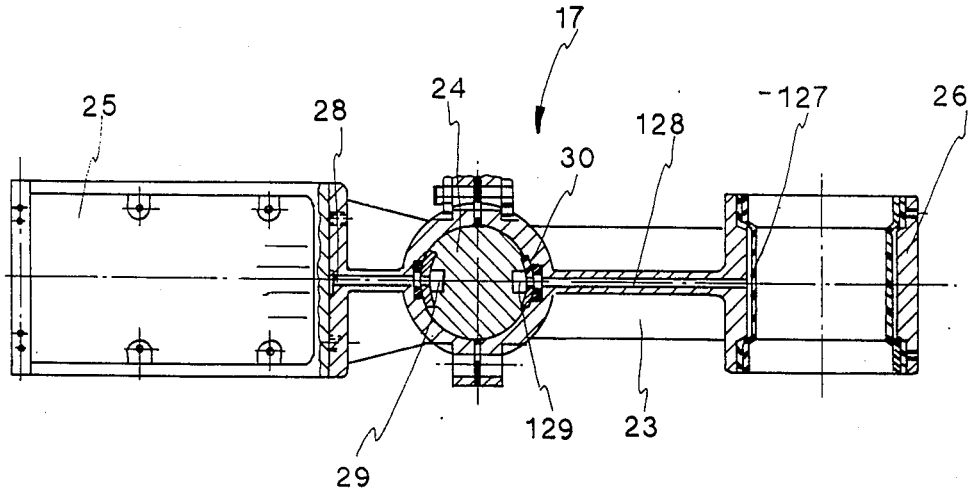
FIG. 3 is a side view of the gripper of FIG. 2.

FIGS. 2 and 3 show a preferred embodiment of the gripper 17. The gripper shown consists of a gripper body 23 solidly fixed to the shaft 24 which actuates rotation of such gripper. In the example shown the gripper 17 comprises an element 25 to engage yarn packages and an element 26 to engage tubes, such elements being located on opposite sides of the shaft 24.

Such elements 25–26 have a substantially cylindrical shape and comprise, on their inner side, membranes 27–127 respectively. Such membbranes can be expanded in a known manner by compressed air delivered through respective feed ducts 29 and 129 and respective delivery channels 28 and 128.

In the example shown the feed ducts 29–129 are provided in the form of lengthwise grooves in the shaft 24, such grooves being closed with strips of rod 30 bored in correspondence with the channels 28–128. Sealing packings are positioned in correspondence with the bored holes.

In a variant which has not been shown here it is possible to feed the compressed air through a set of pipes or conduits which unite the various grippers 17 of a spinning machine in series, a feed position being provided at one end or the other of the series of grippers 17 fitted to the shaft 24.

We have described here a preferred embodiment of the invention, but variants are possible without departing thereby from the scope of the invention. Thus it is possible to provide telescopic guide means other than those shown and tilted, for instance, at a required angle to the vertical; oscillatory arm means, even articulated, can be provided instead of the telescopic means; it is possible to provide grippers actuated mechanically instead of pneumatically; it is possible to have conveyors or creels for the tubes and yarn packages other than those shown, the whole being possible without departing thereby from the scope of the invention.

We claim:

1. A device to doff yarn packages from a ring spinning machine having a spindle shaft, and automatically replace yarn packages with empty tubes, comprising:

a conveyor for supplying empty tubes and removing yarn packages, located above the spindle shaft;

a horizontal shaft;

a gripper rotatably mounted on said horizontal shaft, comprising a first element to engage said tubes and a second element to engage said yarn packages;

means for rotating said gripper 180° about the horizontal shaft in order to bring either of the engagement elements in alignment with the spindle shaft of said ring spinning machine;

a first position where said gripper can either remove yarn packages from or deposit empty tubes on the spindle shaft of the ring spinning machine;

a second position located above the first engagement position where said gripper can either deposit yarn packages onto the conveyor or engage empty tubes from the conveyor; and means for moving said gripper between said upper engagement position and said lower engagement position;

wherein during operation, said device is located above the spindle shaft of the ring spinning machine.

2. The device as claimed in claim 1, wherein the gripper is solidly fixed to said moving means.

3. The device as claimed in claim 1, wherein a plurality of said grippers are rotatably attached to the horizontal shaft.

4. The device as claimed in claim 1, wherein said moving means comprises a telescopic guide able to transfer the gripper vertically.

5. The device as claimed in claim 1, wherein said moving means comprises an oscillatable arm.

6. The device as claimed in claim 1, wherein said gripper operates pneumatically.

7. The device as claimed in claim 6, wherein the pneumatic feed of said gripper is carried out through at least one lengthwise groove in said horizontal shaft.

8. The device as claimed in claim 1, wherein said gripper operates mechanically.

9. The device to doff yarn packages from a ring spinning machine having a spindle shaft, and automatically replace yarn packages with empty tubes, comprising:

a conveyor for supplying empty tubes and yarn packages, located above said spindle shaft;

a horizontal shaft;

a gripper for engaging either the tubes or the yarn packages, rotatably mounted on said horizontal shaft, comprising a first element to engage said tubes and a second element to engage said yarn packages;

means for rotating said gripper 180° about the horizontal shaft in order to bring one of the first or second elements into alignment with the spindle shaft of said ring spinning machine;

a first position located adjacent the spindle shaft where either said first element can deposit an empty tube on the spindle shaft or said second element can remove a yarn package from the spindle shaft;

a second position located above the first position where the means for rotating can rotate the gripper 180°;

a third position located above the second position, where either the first element can remove an empty tube from the conveyor or the second element can deposit a yarn package on the conveyor;

a telescopic shaft located above the spindle shaft which can displace said gripper vertically to the three positions;

wherein while said spinning shaft is in operation, said gripper is located in either said second or third position, or therebetween.

10. A process for doffing yarn packages from a ring spinning machine having a spindle shaft and automatically replacing yarn packages with empty tubes, comprising:

engaging an empty tube from a conveyor with a gripper of a gripping means having a first gripper for engaging empty tubes and a second gripper for gripping yarn packages;

stopping said spindle shaft when a yarn package on the spindle shaft is full;

lowering the gripping means to a first position where the gripping means can cooperate with the spindle shaft, and engaging the yarn package with the second gripper;

raising the gripping means to a second position above the spindle shaft and rotating the gripping means 180° about a horizontal shaft thus bringing the empty tube into alignment with the spindle shaft;

lowering the gripping means to the first position and disengaging the empty tube from the first gripper onto the spindle shaft;

raising the gripping means to a third position above the second position, restarting the spindle shaft, and discharging the yarn package from the second gripper onto the conveyor;

lowering the gripping means slightly, rotating the gripping means 180° around the horizontal shaft, and raising the gripping means back to the third position, thus readying the first gripper to engage another empty tube.

* * * * *